United States Patent [19]

Ignashev et al.

[11] 4,126,031

[45] Nov. 21, 1978

[54] APPARATUS FOR PRODUCING METAL BANDS

[76] Inventors: Evgeny P. Ignashev, ulitsa Korzhenevskogo, 13, kv. 85, Minsk, U.S.S.R.; Evmeny G. Konovalov, deceased, late of Minsk, U.S.S.R., by Nina E. Zaitseva, Georgy E. Konovalov, administrator, ulitsa Akademicheskaya, 13, kv. 20, Minsk; administratix, prospekt Kosmonavtov, 92, kv. 92, Leningrad, both of U.S.S.R.

[21] Appl. No.: 813,673

[22] Filed: Jul. 7, 1977

[51] Int. Cl.[2] ..... B21C 1/02

[52] U.S. Cl. ..... 72/285; 72/DIG. 20; 72/289

[58] Field of Search ..... 72/56, 57, 285, DIG. 20, 72/289, 467

[56] References Cited

U.S. PATENT DOCUMENTS

| | | | |
|---|---|---|---|
| 2,279,347 | 4/1942 | Simons | 72/DIG. 20 |
| 3,209,572 | 10/1965 | Boyd et al. | 72/DIG. 20 |
| 3,434,329 | 3/1969 | Goble | 72/DIG. 20 |

FOREIGN PATENT DOCUMENTS

| | | |
|---|---|---|
| 955,943 | 1/1957 | Fed. Rep. of Germany. |
| 435,699 | 10/1967 | Switzerland. |

*Primary Examiner*—Michael J. Keenan
*Attorney, Agent, or Firm*—Fleit & Jacobson

[57] ABSTRACT

An apparatus has a die with a U-shaped slit for wire passage. The die is connected to an acoustic concentrator of ultrasonic oscillations. The central portion of the slit is parallel to the end face of the concentrator. The wall of the slit central portion that is nearer the concentrator is arranged to be within the zone of the antinode of a standing ultrasonic wave; the area of the wall is not greater than that of the concentrator end face. The length of each lateral portion of the slit is greater than the distance therebetween.

3 Claims, 5 Drawing Figures

APPARATUS FOR PRODUCING METAL BANDS

The present invention relates to metal working, and more particularly to apparatus for producing metal bands or ribbons.

The invention can be most advantageously used for making narrow ultrathin bands or ribbons (a few microns thick) of any metals and alloys.

Narrow ultra-thin metal bands find wide application in modern instruments, e.g. in electronic ones, for various critical parts of measuring heads, electrical measuring instruments, control devices of travelling-wave tubes, current-carrying systems of gyroscopes and aircraft, etc.

With the development of miniature instruments being the current trend in instrumentations industries, there is a growing demand for ultra-thin narrow bands of hard, high-strength and hard-to-work metals and alloys to be used for various instrument components.

Known in the prior art apparatus for producing metal bands do not meet the current requirements and are often incapable of producing high-quality ultra-thin narrow bands. At present, narrow metal bands are produced on two-high and multiroll mills, and in some instances, on mills with friction rolls or with spherical rolls. When light-gauge wires of hard metals are roll-formed into bands by cylindrical rolls, there originates high specific rolling pressures ensuing from the forces acting on a small area of the deformation centre, which results in rapid wear and break-down of the rolls, as well as in poor quality of the surface and wide variation in thickness of the rolled band. These drawbacks take place during the reduction of wires of such hard metals as molibdenum, rhenium, tungsten and their alloys even with carbide rolls. High-quality narrow bands with close tolerances on thickness are hardly ever obtained by rolling. Sometimes, the plasticity of hard metals is increased by heating the wires up to 300°–400° C. in a process known as warm rolling. This, however, involves the oxidation of the band surface on the one hand, and a wide variation in the band thickness on the other, the latter being the result of thermal effects on the rolling mill components (the frame, the rolls, the bearings), which change the initial dimensions and geometrical relationships thereof. To eliminate the heat effect on the mill components, the mills and rolls need to be thermally stabilized, which makes the equipment far more complicated in construction. Furthermore, the accuracy and quality of products rolled on multi-roll mills heavily depend on the accuracy of the rolling mill units and parts, and especially of the roll unit. Inaccuracies in the manufacture of the mill units add up to the overall error of the mill performance which, at high wire-reduction forces, results in defective product. The mills with friction rolls are hardly ever used for producing narrow ultra-thin bands. The mills with spherical rolls produce bands with a biconcave cross-section.

The use of oil, indispensable in rolling for lubrication of the rolls and wire, requires an additional labour-consuming operation to clean the surface of the finished band from residual oil, which may cause damage to the band.

The above-mentioned drawbacks are to some extent eliminated in an ultrasonic device for making narrow bands disclosed in USSR Inventor's Certificate No. 313,593. Here, the wire is passed between two dies, one of which dies is an anvil attached to the frame, and the other is a striker attached to the end face of an acoustic concentrator of ultrasonic waves, said concentrator being rigidly secured to a magnetostrictive transducer. Ultrasonic oscillations are thereby imparted to the striker. The wire being processed is wound from one reel onto the other and shaped into a band by the ultrasonically oscillating striker. Such an ultrasonic process provides for high output of bands.

The dimensional accuracy of the band thus produced depends on a stable gap between the dies (the striker and anvil) during the time of shaping one reel of wire. This gap may change over time because of the elastic deformation of the parts that are subjected to pulsating working forces, and also because of the inevitable thermal expansions (due to the action of propagated ultrasonic waves) of the structural elements carrying the acoustic concentrator and the frame with the dies secured thereto. Since the distance between the locations where said acoustic concentrator and said dies are attached to the frame is fairly tangible (over a hundred millimeters), a small change in temperature of said parts causes a change in the gap between the dies which may mount to several micrometers and exceed the band's thickness tolerance. The cooling of said parts does not fully eliminate that shortcoming. Moreover, this device requires a system for fine adjustment of the gap between the dies.

It is an object of the present invention to produce narrow ultra-thin bands with high-grade surface finish and high dimensional accuracy.

Another object of the invention is to provide a simple manufacturing process for obtaining ultra-thin bands.

Still another object of the invention is to provide an ultrasonic apparatus for making metal bands which is simple in construction.

These and other objects are accomplished in an apparatus for making metal bands, comprising a die, a source of ultrasonic oscillations provided with an acoustic concentrator which adjoins said die, a take-up reel and payoff a reel, a wire tension control mechanism, and a system for cooling the die, wherein, according to the invention, said die is provided with a U-shaped slit for wire passage, the central portion of the slit being parallel to the end face of said acoustic concentrator, the wall of the slit that is nearer to said concentrator being located in the zone of the antinode of a standing ultrasonic wave and having an area not larger than that of said end face of the concentrator, the length of each lateral portions of the slit, directed towards the concentrator, being greater than the distance therebetween.

The present invention can supersede rolling mills of any make used in the production of narrow ultra-thin bands from wires 0.4 mm and less in diameter of any metal and alloy currently employed in instrument making. The simultaneous action of acoustic and pulsating impact forces upon the wire being processed makes for lower elastic limit of the wire, its higher plasticity, and so reduces the deformation forces. That also reduces contact friction in the wire deformation zone and makes possible intensive shaping for a run of the wire. The output of the production process with the use of the present invention is much higher than that of the processes with the use of rolling mills. The use of water as a medium for cooling the die excludes contamination of the obtained band and so obviates the need for subsequent cleaning thereof. Moreover, the use of a cooling medium capable of dissolving impurities, or of water with surface-active agents added therein, promotes additional cleaning of the band during its processing, which is impossible to do in conventional processes of band making.

Pulse dynamic action of the walls of the slit central portion at an ultrasonic frequency on the wire being worked, as well as lower contact friction in the deformation zone result in the smoothing-out of macroirregularities on the wire surface and, accordingly, in high-quality finish of the band surface. Since the thickness of the band is defined by the size of the slit on its central portion, thermal changes of the slit, which are negligible owing to a small size of the die itself, do not affect stable thickness of the band. This makes it possible to obtain metal bands with the thickness tolerance within tenths of a micrometer.

In an apparatus according to the invention, the width of the slit on its central portion is greater than the thickness of the band to be obtained by the value equal to the amplitude oscillations of the wall of the slits central portion that is nearer to the acoustic concentrator.

Such an arrangement simplifies the running of the manufacturing process because adjustment of the apparatus for the size of the band to be produced is not needed. The apparatus should be provided with a set of changeable dies with slits of specified sizes. To produce a band of the specified thickness, the corresponding die is set up on the apparatus.

In the apparatus according to the invention, the die consists of two parts rigidly connected to one another.

The die with its slit is a single unit, consisting of two parts acting as a striker and anvil which are imparted ultrasonic oscillations from a single source thereof.

The present invention makes the apparatus simpler in construction, because there is no need for a mechanism for fine adjustment of the gap between the two parts.

Other objects and advantages of the present invention will be apparent from the following detailed description with reference to the accompanying drawings, wherein.

Figure 1:
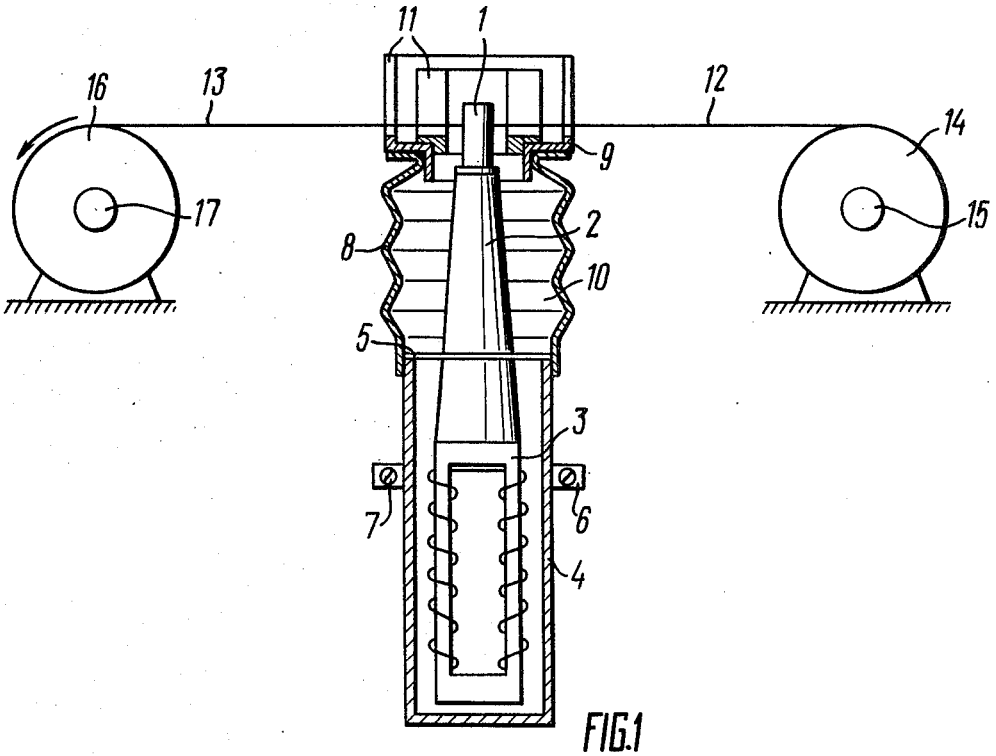
FIG. 1 is a diagrammatic view of an apparatus embodying the present invention.

Referring now to the accompanying drawings and to FIG. 1 in particular, there is shown therein the proposed apparatus which comprises a die 1 connected to an acoustic concentrator 2 of ultrasonic oscillations, which concentrator is soldered with the aid of a hard solder to a source of ultrasonic oscillations, such as magnetostrictive transducer shown at 3, with a power of 400 W. The transducer 3 is mounted within a housing 4. The acoustic concentrator 2 with the die 1 is attached to a flange 5 of the housing 4. The die 1, concentrator 2 and transducer 3 make up an ultrasonic system with a resonant frequency of 22 kHz.

The housing 4 is secured to the apparatus frame (not shown) by means of a collar 6 and screws 7.

A system for cooling the concentrator 2 with the die 1 includes an undulated tube 8 made of resilient plastic, with one end of the tube being secured to the housing 4, the other one carrying a chamber 9. The tube 8, which encloses the concentrator 2, is filled with coolant 10 poured thereinto through the chamber 9. The walls of the chamber 9 have through slots 11 for the passage of wire 12 and finished band 13. The wire 12 is wound onto a payoff reel 14 mounted on the shaft 15 of a band brake mechanism (not shown), and the band 13 is fixed on a take-up reel 16 mounted on the shaft 17 of a d.c. electric motor (not shown).

Figure 2:
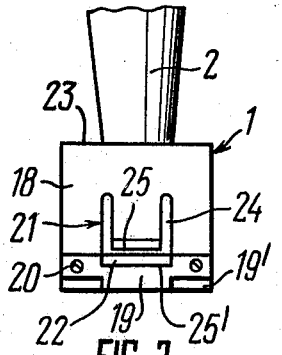
FIG. 2 is a general view of a die.
Figure 3:
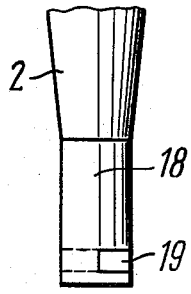
FIG. 3 is a side view of same.
Figure 4:
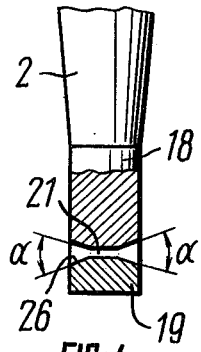
FIG. 4 is a sectional view taken across the slit, along the direction of wire movement.

The die 1 (see FIGS. 2, 3 and 4) is composed of two parts: a trident 18 and a brace 19 which is inserted into slots on the lateral prongs 19' of the trident 18 and secured thereto by means of screws 20. A U-shaped slit is thereby formed in the die 1 for the passage of the wire 12. The central portion 22 of the slit 21 is parallel to the end face 23 of the concentrator 2, whose length is equal to one-half wavelength ($\lambda/2$) of an ultrasonic wave. The length of each lateral portions 24 of the slit 21 is greater than the distance between these two portions 24.

Figure 5:
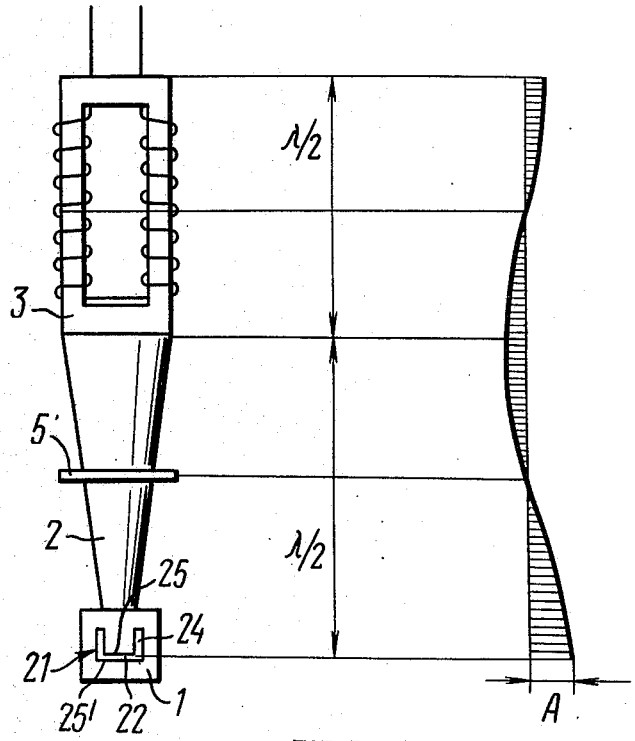
FIG. 5 is a diagrammatic view of an ultrasonic transducer with an acoustic concentrator and a die, and a chart of the amplitude of a standing ultrasonic wave.

The overall dimensions of the die 1 are adopted so that the die 1, the concentrator 2 and the transducer 3 connected to each other form a resonant acoustic system. The wall 25 of the central portion 22 of the slit 21, which is nearer to the concentrator 2, is situated in the zone of the antinode of the standing ultrasonic waves propagated in the ultrasonic system, i.e. the oscillations of the wall 25 have the maximum amplitude A as shown in FIG. 5. The area of the wall 25 of the slit 21 does not exceed the area of the end face 23 of the concentrator 2. The overall dimensions of the die 1 are smaller than the length of the ultrasonic wave by a factor of 10 to 15. The slit is provided with tapered portions 26 made at an angle of $\alpha = 4°-20°$ at both end faces where the wire enters and the band leaves the die 1.

The apparatus operates as follows.

The payoff reel 14 (see FIG. 1) with the wire 12 is set up on the shaft 15 of the band brake mechanism. The chamber 9 is lowered and the die 1 is thereby made to leave said chamber 9 and retain its position thereabove. The wire 12 is passed through one of the lateral portions 24 of the slit 21 (see FIG. 2) and secured to the reel 16 (see FIG. 1) mounted on the shaft 17 of the d.c. motor (not shown). The chamber 9 is lifted to the initial position, where the die 1 is within the chamber, and the wire 12 passes through the slots 11 thereof. The chamber 9 and the tube 8 are then filled with coolant 10, e.g. water. The ultrasonic generator (not shown) is energized, the optimal tension of the wire 12 is adjusted with the aid of the band brake (not shown) and the motor that carries on its shaft 17 the take-up reel 16 is started. Under the action of tension force the wire 12 tends to straighten out and is thereby caused to pass from the respective lateral portion 24 of the slit 21 to the central portion 22 thereof. At this moment the band 13 begins to wind up on the take-up reel 16. The optimal speed of movement of the wire 12 is set up with the aid of the motor so that the finest bands of frail metals travel at the lower speeds, and the thicker bands of strong metals, at the higher speeds of the range. These speeds vary from 1 to 200 m per min depending on the thickness of the wire 13 to be obtained.

Owing to the arrangement of the die 1 according to the present invention, ultrasonic waves are propagated through its central prong 18, which is coaxial with the concentrator 2, to the wall 25 of the slit's central portion 22. That provides the oscillation of the wall 25 with the maximum amplitude. Transverse ultrasonic waves which at the same time run through the other part of the die 1, namely the brace 19, create favourable conditions for the process of reducing the wire 12 to the band 13 rather than impair the operation. Tangential oscillations of the wall 25' of the central portion 22 of the slit 21, the wall that is farther from the concentrator 2, make for lower contact friction between the wire 12 being processed and the walls 25 and 25' of the slit 21 of the die 1, which results in high surface finish of the band 13. The contraction of the width of the slit 21 in each oscillation cycle by a value equal to the amplitude of oscillation of the wall 25 of the slit 21 produces an impact force which is imparted by the walls 25 and 25' to the wire 12 and so shapes the wire into the band 13. The reduction of the wire 12 takes place in the region of the tapered portion 26 of the slit 21, whereas the band 13 thus formed is seized and smoothed out in the slit proper. The dissipation, refraction and diffraction of elastic ultrasonic waves within the body of the die 1 cause part of the ultrasonic energy to heat the die. The heating of the die 1 and the wire 12 to high temperatures may cause the oxidation of the band 13 and even destruction of the die. To prevent the heating, the die and the wire are cooled down with flowing liquid, e.g. water, oil emulsion, etc. The resulting low-degree heating of the wire 12 in the deformation zone increases the plasticity of the wire and so facilitates the process of its reduction. This heating, however, does not cause oxidation of the band 13, since a portion of the wire 12 which is being reduced in the deformation zone by the action of mechanical and acoustic impact forces does not stay there longer than $1.10^{-3}$ to $1.10^{-4}$ s. The stable thickness of the band 13 depends on the amplitude of oscillation and dimensional stability of the slit 21. The change of the slit size due to the above heating is negligible and hardly affect the accuracy of the band 13. For this reason, the present invention makes it possible to produce high-precision ultra-thin bands of any metal or alloy. The apparatus according to the invention ensures a productive output which is 5 to 10 times that offered by conventional rolling and flattening mills. The apparatus is simple in construction. To produce bands of different thickness, a set of dies according to specified bands should be provided for the apparatus. Change-over of the apparatus from one band thickness to another is carried out by setting up the die of the required size.

We claim:

1. An apparatus for producing metal bands from wire, comprising: a die having a U-shaped slit for the passage of said wire, a source of ultransonic oscillations with an acoustic concentrator whose end face adjoins said die, said slit having a central portion which is parallel to said concentrator end face and two lateral portions which are directed towards said concentrator, one wall of said central portion of the slit which is nearer to said concentrator being located within the zone of the antinode of a standing ultrasonic wave produced by said source of ultrasonic oscillations, the area of said wall being not greater than that of said concentrator end face, the length of each said lateral portion of said slit being greater than the distance therebetween; a payoff reel for said wire and a take-up reel for said band; a system for cooling said die; and a wire tension control mechanism.

2. An apparatus according to claim 1, wherein the width of the slit on its central portion is greater than the thickness of the band to be produced by the value equal to the amplitude of oscillations of said wall of the central portion of the slit that is nearer to the concentrator.

3. An apparatus according to claim 1, wherein the die is composed of two parts rigidly connected to each another.

* * * * *